United States Patent [19]

Downing et al.

[11] 4,126,237

[45] Nov. 21, 1978

[54] LIFT TRUCK SAFETY SYSTEM HAVING PROTECTION AGAINST COMPONENT FAILURE

[75] Inventors: Terry R. Downing, Hazel Crest, Ill.; Allois F. Geiersbach, Milwaukee, Wis.

[73] Assignee: Allis-Chalmers Corporation, Milwaukee, Wis.

[21] Appl. No.: 789,193

[22] Filed: Apr. 20, 1977

Related U.S. Application Data

[63] Continuation-in-part of Ser. No. 666,045, Mar. 11, 1976, abandoned.

[51] Int. Cl.[2] ..... B66F 9/20

[52] U.S. Cl. ..... 214/674; 340/685

[58] Field of Search ..... 214/673, 674; 340/267 C; 212/39 MS

[56] References Cited

U.S. PATENT DOCUMENTS

| | | | |
|---|---|---|---|
| 3,866,200 | 2/1975 | Paredes et al. | 340/267 C |
| 3,951,467 | 4/1976 | Fleagle | 303/92 |
| 3,993,166 | 11/1976 | Senour | 340/267 C |
| 4,003,487 | 1/1977 | Downing | 212/39 MS |
| 4,013,324 | 3/1977 | Quon | 303/92 |

*Primary Examiner*—Lawrence J. Oresky
*Attorney, Agent, or Firm*—Lee H. Kaiser

[57] ABSTRACT

A fork lift truck has an overload protective circuit which is responsive to an excessive tilting moment acting on the truck, as a result of a load on the raised carriage, to disable the mast tilting motor and carriage elevating motor from shifting the load supporting carriage in a direction which would increase the forward tilting moment and also has a crowbar circuit which, upon failure of the protective system to respond properly to such excessive tilting moment, opens an electrical circuit that also results in inhibiting the mast tilting and carriage elevating motors from further raising the carriage or further forward tilting of the mast on the overloaded truck, thereby providing enhanced protection against faulty operation resulting from component failure. One embodiment permits the truck operator to selectively simulate an overload and thereby initiate testing for component failure in the overload protective system. Another embodiment is self-testing and simulates an overload to thereby initiate testing for component failure each time the truck electrical system is turned on.

20 Claims, 2 Drawing Figures

LIFT TRUCK SAFETY SYSTEM HAVING PROTECTION AGAINST COMPONENT FAILURE

This application is a continuation-in-part of our application Ser. No. 666,045 filed Mar. 11, 1976, now abandoned.

BACKGROUND OF THE INVENTION.

This invention relates to an overload protective system for a fork lift truck which is responsive to an excessive tilting moment acting on the truck, as a result of a load on a carriage elevated on a tilted mast, to inhibit further raising of the carriage of further forward tilting of the mast, thereby preventing the operator from increasing the danger of overturning the truck during material handling operations.

Overload protection systems for a fork lift truck are known of the type disclosed in U.S. Pat. No. 4,003,487 in the name of Terry R. Downing having the same assignee as this invention which monitors the overturning, or tilting moment acting on the truck and generates an overload, or trip signal when the overturning moment is excessive and, in response to the trip signal, disables the mast tilting motor and the carriage elevating motor from shifting the carriage in a direction which would increase the danger of overturning the truck. However, such known overload protective systems may include a complex electronic circuit with many electronic components which can fail and thus prevent the protective circuit from responding properly to the excessive overload, and consequently it is possible to raise the carriage further on an already overloaded truck which has a failed component in the protective system and to also tilt the mast thereof further forward, thereby increasing the danger of overturning the truck which is already overloaded.

OBJECTS OF THE INVENTION

It is an object of this invention to provide a lift truck overload safety system having enhanced protection against faulty operation due to component failure.

It is a further object of the invention to provide an overload protection system for a lift truck which guards against failure of components in the protective system.

Another object of the invention is to provide an overload protective system for a lift truck which monitors the overload signal that is generated as a result of an excessive overload on the truck and opens an electrical circuit to prevent further lifting and forward tilting if the protective circuit fails to respond properly to the overload signal.

Still another object is to provide a lift truck having such an overload protective system which guards against failure of components and also has means to selectively simulate an overload on the truck and thereby initiate testing for component failure. A specific object is to provide an automatically self-testing protective system which simulates an overload on the truck each time the truck electrical system is turned on, as, for example, by turning on a key switch.

SUMMARY OF THE INVENTION

A lift truck embodying the invention has a tilting mast; a mast tilting motor; a load supporting carriage; a carriage elevating motor for raising and lowering the carriage on the mast; an overload protective system including a sensor for deriving an electrical tilting-moment signal proportional to the tilting moment acting on the truck as a result of a load on the raised carriage; a comparator for deriving an overload signal when the tilting-moment signal reaches a predetermined magnitude indicative of an overload on the truck; an electrical switch coupled to the output of the comparator and normally being held unoperated by such output and being operated in response to the overload signal; means for disabling the mast tilting and carriage elevating motors in response to operation of the electrical switch; and crowbar circuit means for operating the motor-disabling means in response to the simultaneous occurrence of: (a) the overload signal together with (b) the electrical switch remaining unoperated after a time delay subsequent to the occurrence of the overload signal, thereby disabling the mast tilting and carriage elevating motors from increasing the forward tilting moment when the truck is overloaded but the overload protective means fails to properly respond to the excessive tilting moment. The overload protective system may have means for selectively simulating an overload on the truck which causes the sensor to derive a tilting-moment signal said predetermined magnitude and thereby initiate testing for component failure.

In a preferred embodiment the overload sensor includes a load supporting member subjected to a load proportional to the tilting moment acting on the truck, a plurality of strain gages mounted on the load supporting member and arranged in an electrical bridge for detecting the mechanical strain in the load supporting member and for deriving the tilting moment signal, and a differential amplifier having its inputs coupled across a diagonal of the bridge. The electrical switch comprises a normally conducting semiconductor switch which is turned off in response to the overload signal. The means for disabling the mast tilting and carriage elevating motors in response to the overload signal preferably comprises hydraulic blocking valves having operating coils in series with the normally conducting semiconductor switch and holding the valves in open position wherein the mast tilting and carriage elevating motors are enabled, but operating the valves to closed position, when the semiconductor switch is turned off in response to the overload signal, wherein fluid is blocked from flowing to the mast tilting and carriage elevating motors in a direction which would increase the forward tilting moment acting on the truck. The crowbar circuit preferably includes an RC capacitor charging circuit which receives the overload signal as an input; means controlled by the semiconductor switch for disabling the capacitor charging circuit when the switch is turned off; a rupturable fuse in series with the semiconductor switch; and means responsive to a predetermined voltage on the capacitor for applying a power source across the fuse to rupture it and open the circuit to the semiconductor switch, thereby disabling the mast tilting and carriage elevating motors of the overloaded truck in the event that the overload protective system fails to operate properly in response to the overload signal. The means for selectively simulating an overload on the truck preferably unbalances the strain gage electrical bridge to derive the tilting-moment signal of said predetermined magnitude and simultaneously applies a signal analogous to the overload signal to the crowbar circuit. In a preferred automatically self-testing embodiment, an overload on the truck is simulated each time the truck starting key is turned on.

DESCRIPTION OF THE DRAWINGS

These and other objects and advantages of the invention will be more readily apparent from the following detailed description when considered in conjunction with the accompanying drawings wherein.

DETAILED DESCRIPTION

Figure 1:
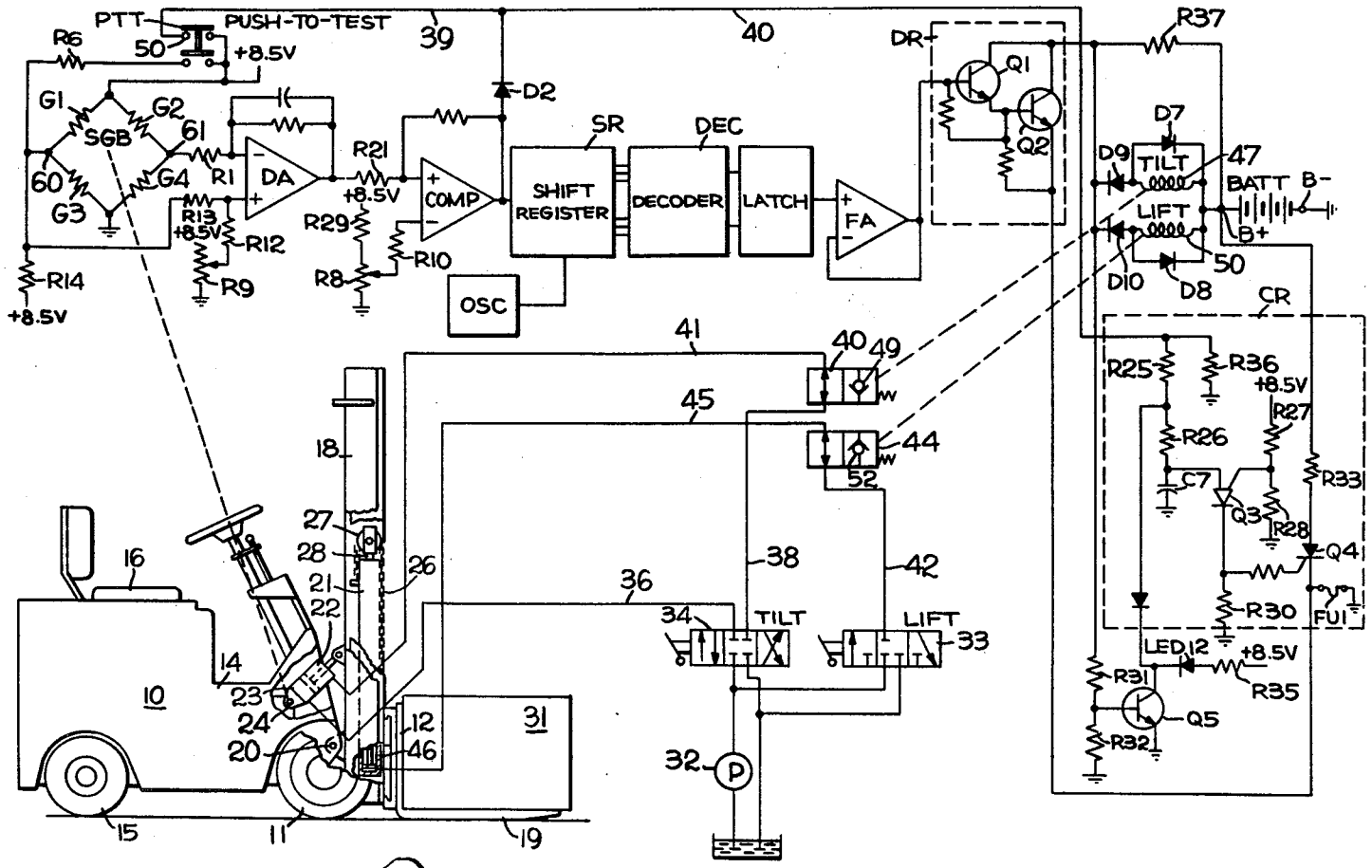
FIG. 1 is a schematic diagram of an overload protective system for a lift truck embodying the invention with portions of the known system shown in block form.

The invention is illustrated in FIG. 1 of the drawing as being incorporated in an overload protective system for a lift truck disclosed in U.S. Pat. No. 4,003,487 to Terry R. Downing having the same assignee as this invention and which continuously monitors the overturning, or tilting moment acting on a counterbalanced lift truck 10 tending to tilt the truck about its front wheels 11 and which operates in response to a predetermined excessive tilting moment to prevent shifting of a load support carriage 12 in either a horizontal direction or in a vertical direction which would increase the forward tilting moment. The lift truck 10 may have a main frame 14, a pair of steerable rear wheels 15, an operator's seat 16, a vertical mast 18 pivotally connected to frame 14 on a transverse axis by pins 20, a carriage elevating motor which preferably comprises a single lift jack 21 for elevating and lowering carriage 12 with forks 19 on mast 18, and a mast tilting motor which preferably comprises double acting hydraulic tilt jack 22 for tilting mast 18. Tilt jack 22 has a tilt cylinder 23 pivotally connected on a transverse axis to the frame 14 about a load carrying tilt jack anchor pin 24 and a piston rod pivotally connected on a transverse axis to mast 18. Lift jack 21 includes a hydraulic lift cylinder 46 which supports the carriage 12 through a chain 26 trained over a pulley 27 mounted on the top of lift jack piston 28. When a load 31 is supported on forks 19 and mast 18 is tilted, an overturning moment acts on truck 10 tending to tilt it about front wheels 11 as a fulcrum, and such overturning moment is resisted by tilt jack 22 and tilt jack anchor pin 24, whereby pin 24 is subjected to mechanical stress which is proportional to the tilting moment acting on the truck 10.

The hydraulic control system for carriage elevating motor 21 and mast tilting motor 22 may include a pump 32; manually operable lift and tilt control valves 33 and 34; a tilt cylinder supply conduit 36 connecting the manual tilt control valve 34 with the closed end of the tilt cylinder 23; a tilt supply conduit 38 connecting tilt valve 34 to a tilt blocking valve 40 which is connected through a conduit 41 to the rod end of tilt cylinder 23; a lift supply conduit 42 connecting the manual lift valve 33 to a lift blocking valve 44 which is connected through a conduit 45 to the bottom end of lift cylinder 46.

Tilt blocking valve 40 is normally held open by its operating coil 47 which is energized during normal material handling operations, thereby permitting the truck operator to tilt mast 18 forward by operating tilt valve 34 to supply pressurized fluid from pump 32 to the closed end of tilt cylinder 23 through conduit 36 and force fluid out of the rod end of tilt cylinder 23 through conduit 41. When operating coil 47 of tilt blocking valve 40 is deenergized, valve 40 closes so that check valve 49 prevents discharge of fluid from the rod end of tilt cylinder 23 through conduit 41, thereby disabling the mast tilting motor and inhibiting it from further forward tilting of mast 18, but check valve 49 permits the operator to supply pressurized fluid from pump 32 to the rod end of the tilt cylinder 23 through conduit 41 and thereby actuate the mast tilting motor to decrease the forward tilt of mast 18.

Lift blocking valve 44 is normally held open by its operating coil 50 which is energized during material handling operations, thereby permitting the operator to raise carriage 12 by supplying pressurized fluid through valves 33 and 44 in series and conduit 45 to the bottom end of lift cylinder 46, or to lower carriage 12 by exhausting fluid from cylinder 46. When operating coil 50 is deenergized, lift blocking valve 44 closes so that check valve 52 blocks supply of pressurized fluid to the bottom end of lift cylinder 46, thus disabling the carriage elevating motor from raising carriage 12 but permitting the truck operator to lower the load 31 under control of manual valve 33.

The safety system for preventing excessive tilting moment on the truck may include four resistance strain gages G1, G2, G3, G4 mounted externally on tilt anchor pin 24 and arranged in a full bridge electrical circuit SGB. Strain gage bridge SGB derives an electrical "tilting-moment" or "strain" signal proportional to the mechanical strain in pin 24 and thus of the tilting moment acting on truck 10, and a differential operational amplifier DA raises the level of the output signal from bridge SGB. A comparator operational amplifier COMP receives the output of differential amplifier DA and derives a trip or overload signal when the tilting-moment signal reaches a predetermined magnitude indicating that excessive overturning moment is acting on the truck.

The junction of strain gages G3 and G4 may be grounded and a regulated unidirectional power supply shown as +8.5 volts may be applied across a diagonal of the bridge between the junction of strain gages G1 and G2 and ground. When no load is supported on carriage 12, the strain gage sensor bridge SGB will be unbalanced due to the weight of carriage 12 and mast 18 and also due to difference in the resistances of the strain gages resulting from manufacturing tolerances, and an unbalance voltage may exist across bridge output terminals 60 and 61 which must be compensated for since the output of high gain differential amplifier DA would swing over a wide voltage range as a result of relatively small differential voltage applied across its inputs. Isolating resistances R1 and R13 respectively connect bridge output terminals 61 and 60 to the inverting and noninverting inputs of the high gain differential amplifier DA of the protective system. Bridge SGB becomes further unbalanced when a force due to load 31 is applied to tilt anchor pin 24, and bridge SGB generates a tilting-moment, or strain signal, in proportion to mechanical strain in anchor pin 24, and thus to the overturning moment acting on the truck 10. Bridge output terminal 60 is connected through a resistance R14 to the +8.5 volt supply to formm a voltage divider of four series resistances R14, R13, R12 and R9 to ground. The noninverting input of differential amplifier DA is coupled through resistance R12 to the wiper of a bridge unbalance compensation potentiometer R9 whose winding is connected between the +8.5 volt supply and ground and which permits compensation for minor unbalance in bridge SGB so that, after adjustment by R9 to set the output of amplifier DA to approximately zero volts, the inputs of DA effectively see zero voltage across the bridge output terminals 60 and 61 when carriage 12 is unloaded. The currents resulting from bridge unbalance and from voltage divider R14, R13, R12, R9 are summed at the noninverting input of DA and the sum can be set to zero by adjusting compensation potentiometer R9 so that bridge SGB is, in effect, balanced. A visual indicator (not shown) may be provided, as disclosed in aforementioned U.S. Pat. No. 4,003,487, to give a visual signal when the output of differential amplifier DA is approximately zero volts, thereby indicating that zero potential difference exists between the inverting and noninverting inputs to amplifier DA and that bridge SGB is balanced.

The output of differential amplifier DA is coupled through a resistance R21 to the noninverting input of comparator operational amplifier COMP which generates a trip or overload signal when the forward tilting moment acting on the truck 10, and thus the strain signal from bridge SGB, exceeds a predetermined magnitude. The inverting input of COMP is coupled through a resistance R10 to the wiper of a trip point adjustment potentiometer R8 whose winding is connected in series with a resistance R29 between the +8.5 volt supply and ground so the output of COMP is normally logic zero. Trip point adjusting potentiometer R8 applies a predetermined positive voltage to the inverting input to COMP and thus permits setting of the predetermined forward tilting moment beyond which carriage 12 should not be raised or mast 18 tilted further forward.

The output from comparator COMP is applied to the data input of a shift register SR shown in block form which also receives a train of clock pulses from an oscillator OSC as a time reference and records the history of the output of comparator COMP over a period of time, i.e., whether the trip signal caused by excessive tilting moment has existed for a period of time. The data accumulated in shift register SR is analyzed in a decoder DEC that sets a latch LATCH shown in block form which, in response thereto, generates a disable logic zero signal. The disable signal from the LATCH is coupled through a voltage follower amplifier FA to an operating coil drive amplifier and electrical switch DR including two transistors Q1, Q2 connected in Darlington arrangement with the disable signal applied to the base of Q1 to turn Q1 off. Such electrical switch opens and closes the electrical circuit to paralleled solenoid operating coils 47 and 50 and may be a relay (not shown) but preferably comprises a normally conducting semiconductor switch Q1, Q2 of the Darlington transistor type which also amplifies the output from the LATCH. Turning off of Q1 also turns off the semiconductor switch NPN power transistor Q2 which is connected in series with the paralleled operating coils 47 and 50 between the positive terminal B+ and the grounded negative terminal B− of a battery BATT carried by the truck, thereby deenergizing operating coils 47 and 50 of blocking valves 40 and 44 respectively to prevent further raising of load support carriage 12 and also preventing further tilting of mast 18 in the forward direction.

Transistors Q1 and Q2 are connected in Darlington arrangement with the emitter-collector circuit of Q2 in series with a fuse FU1 of "crowbar" circuit CR (shown within a dashed line rectangle) and with the paralleled operating coils 47 and 50 and the battery BATT. Under normal material handling conditions, the output of the LATCH is logical one voltage which maintains semiconductor switch Q2 in conduction so that coils 47 and 50 are continuously energized to hold blocking valves 40 and 44 open and thus permit pressurized fluid from pump 32 to be supplied respectively to the rod end of tilt cylinder 23 and to the bottom end of lift cylinder 46. Diodes D10 and D9 connected respectively between the coils 50 and 47 and the collector of Q2 isolate the blocking valve operating coils. Diodes D8 and D7 connected in shunt respectively to operating coils 50 and 47 provide paths for free-wheeling of solenoid currents when the overload protective means is operated to turn off Darlington driver transistor Q1. The LATCH and the operating coil drive amplifier and electric switch DR may be considered disabling means which close blocking valves 40 and 44 and thus inhibit the lift jack 21 and tilt jack 22 from operation in a direction which would increase the forward tilting moment on truck 10 but permit the operator to lower carriage 12 and tilt mast 18 backward.

The lift truck operator cannot tell whether the protective system is functioning correctly and thus does not know whether his lift truck is protected from picking up an overload. A push-to-test pushbutton PTT may be provided on truck 10 to permit the operator to simulate an overload on the truck. Operation of pushbutton PTT connects the power supply +8.5 volts through a resistance R6 to bridge output terminal 60, thereby unbalancing bridge SGB and applying a positive voltage to the noninverting input of differential amplifier DA having a magnitude greater than the predetermined tilting-moment signal output of bridge SGB which results in derivation of the trip signal by COMP. DA amplifies such unbalance signal and provides an output which is detected by comparator COMP and generates a trip or overload signal in response thereto. The trip signal output from comparator COMP is transmitted through shift register SR, decoder DEC, and the LATCH to turn off Darlington transistor Q2. The collector of Q2 is coupled through two series resistances R31 and R32 to ground, and the junction between R31 and R32 is coupled to the base of a transistor Q5 whose collector is connected through a light emitting diode LED 12 in series with a resistance R35 to the power supply +8.5 volts. During normal material handling operations Q2 is turned on so that its collector voltage is low, with the result that the base of NPN transistor Q5 is biased at a sufficiently low voltage so that Q5 is turned off and LED 12 is not lighted. When the operator pushes button PTT, transistor Q2 is turned off if the components of the protective system are functioning properly, and the resulting increase in voltage at the collector of Q2, when it is turned off, causes increased current flow through R32 and develops a voltage thereacross which increases the bias on the base of NPN transistor Q5 and turns it on. The resulting flow of collector current in Q5 also passes through light emitting diode LED 12 and illuminates it to provide a visual indication to the truck operator that the protective system is operating properly and that the truck is protected from picking up an overload. The voltage divider R31, R32 prevents Q5 from being turned on by the slight positive voltage at the collector of Q2 when Q2 is normally conducting during material handling operations. Light emitting diode LED 12 also turns on when an overload occurs during material handling operations of truck 10. However, if transistor Q2 has failed in shorted condition, or if a component failure prevents Q2 from turning off, diode LED 12 will not light when the operator depresses pushbutton PTT, thereby indicating to the operator that a fault exists in the protective system and that the truck is not protected against picking up an overload.

Crowbar circuit CR guards against failure of components in the electrical circuit between comparator COMP and the operating coils 47 and 50 by disabling the carriage elevating and mast tilting motors in the event that the protective system fails to respond properly to the trip signal. The crowbar circuit preferably parallels the protective system circuit and continuously monitors the trip signal (which is indicative that a truck overload exists) and accomplishes crowbar action by rupturing fuse FU1 to disable the mast tilting and carriage elevating motors if semiconductor switch Q2 is not turned off in response to generation of the trip signal. The trip signal is indicative that an overload exists, and failure of Q2 to turn off in response to such overload signal is indicative of component failure. Rupturing of fuse FU1 to assure that the overturning moment acting on the overloaded truck cannot be increased under such simultaneous overload and component-failure conditions makes the truck overload protective system as fail-safe as practical.

If an overload occurs on truck 10, a logical one voltage trip signal will be generated by comparator COMP which will cause the LATCH to derive a logical zero disable signal that should turn off Q2 to deenergize tilt solenoid 47 and lift solenoid 50. However, a component failure may prevent transmittal of the trip signal to the driver amplifier DR and, further, transistor Q2 may fail in a shorted mode. Under either such component failure condition, the tilt and lift solenoid would not be deenergized when overload occurs, and consequently the truck would not be protected against picking up an overload. In order to guard against such component failure, the logical one overload, or trip signal derived by comparator COMP may be coupled through a diode D2 and over a lead 40 and through two series resistances R25 and R26 to initiate charging of a capacitor C7 of the crowbar circuit. Under normal material handling conditions Q2 will be turned off as a result of the trip signal, thereby increasing its collector voltage and developing a voltage across R32 which increases bias on Q5 and turns it on. The emitter-collector path of Q5 is connected in series with a diode D11 between ground and the junction between resistances R25 and R26, and turning on of Q5, in effect, shorts C7 to ground (through D11 and Q5) to prevent C7 from accumulating a charge under such nonfault conditions. Resistances R25 and R26 limit charging current to capacitor C7 and provide an RC time delay in charging C7. Transistor Q5 prevents crowbar action by disabling the charging circuit to C7 under normal circuit conditions. R26 also limits collector current of Q5 when C7 discharges through Q5. Resistance R37 provides base bias to Q5 and prevents LED 12 from lighting in the event that both operating coils 47 and 50 are open-circuited or removed.

Crowbar action occurs if a component of the protective circuit fails and prevents Q2 from turning off when the trip signal is generated. Under such simultaneous overload and failed-component conditions, Q2 remains on and Q5 remains off, and the logical one voltage trip signal generated by comparator COMP charges capacitor C7 through R25 and R26 to effect crowbar action. C7 is charged by the trip signal through R25 and R26 in series (since Q5 is not turned on) at a rate dependent upon the RC time constant of C7 times (R25 plus R26). Capacitor C7 is coupled to the anode of a programmable unijunction transistor Q3 whose anode-cathode path is connected in series with a resistance R30 between capacitor C7 and ground. The preselected triggering level at which Q3 becomes conductive is determined by a voltage divider comprising two series resistances R27 and R28 connected between the +8.5 volt supply and ground with the junction between R27 and R28 coupled to the gate of Q3. When the voltage built up across C7 reaches such triggering level, Q3 fires and discharges C7 through its anode-cathode path and resistance R30 to ground. The resulting current flow through R30 develops a voltage which is impressed through a resistance R29 upon the gate of an SCR, or thyristor Q4, and turns it on. The anode-cathode circuit of Q4 is connected in series with a resistance R33 between the positive terminal B+ of the battery BATT and one side of fuse FU1, and conduction by Q4 applies the voltage of battery BATT across fuse FU1 in series with resistance R33 to accomplish crowbar action. Consequently fuse FU1 ruptures, thereby opening the current path to the emitter of Q2 and also to the tilt and lift solenoids 47 and 50, and preventing the mast tilting motor and the carriage raising motor from operating carriage 12 in a direction which would increase the forward tilting moment acting on truck 10. R33 limits the peak current in thyristor Q4.

In the push-to-test mode, crowbar circuit CR reacts to failure of any component in the protective circuit by rupturing fuse FU1 to thereby disable the carriage raising and mast tilting motors from increasing the tilting moment acting on truck 10. As described hereinbefore, when pushbutton PTT is depressed, bridge SGB is unbalanced and causes comparator COMP to generate the trip signal which results in Q2 turning off and Q5 turning on, under nonfault conditions, to thereby light LED 12 and short C7 to thereby prevent crowbar action. However, if Q2 should fail shorted or if other component failure prevents Q2 from turning off when pushbutton PTT is depressed, the collector voltage of Q2 will remain low and consequently Q5 will not be turned on. The logical one trip signal generated by comparator COMP, as a result of bridge unbalance when PTT is depressed, will be coupled through D2 and over lead 40 of the crowbar circuit to charge capacitor C7.

If a component failure exists in bridge SGB or in amplifier DA or in the comparator COMP which prevents generation of the trip signal by COMP when PTT is depressed, the +8.5 volts supply will be connected through the contacts 50 of PTT and over leads 39 and 40 to apply a signal analogous to the overload signal to the crowbar circuit to thereby charge capacitor C7 and thus effect crowbar action.

Figure 2:
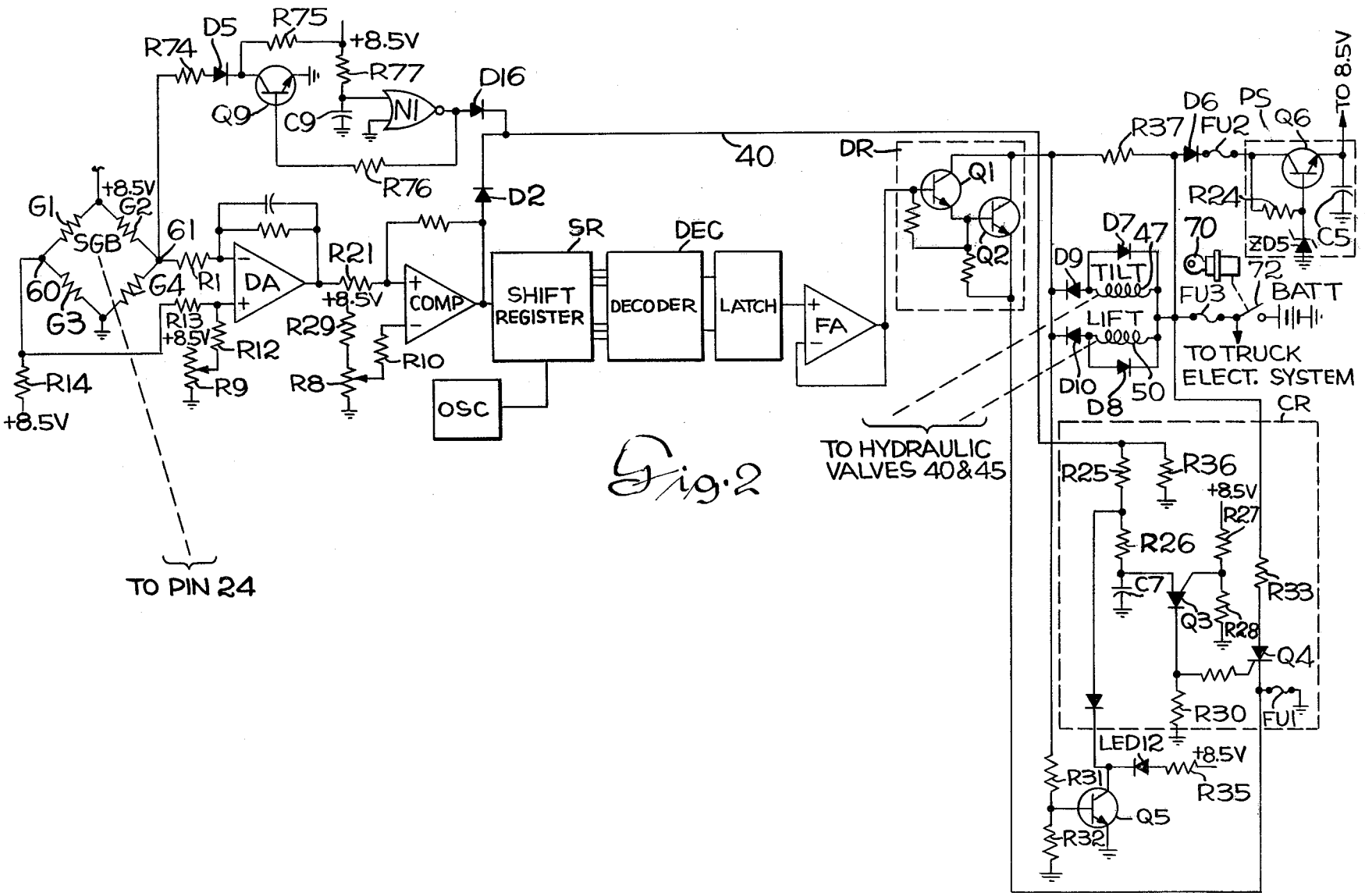
FIG. 2 is a schematic diagram of an automatically self-testing embodiment of protective system which simulates an overload on the truck each time the truck starting key is turned on (the showing of the truck and the hydraulic control being omitted since they are identical to FIG. 1).

FIG. 2 illustrates an automatically self-testing embodiment which automatically simulates an overload on the truck and tests for a faulty component each time the truck starting key 70 is turned on to apply power to the truck electrical system (not shown). The lift truck and the hydraulic circuit are omitted from FIG. 2 to simplify the drawing since these elements are identical to those shown in FIG. 1. The embodiment of FIG. 2 tests for a faulty electronic component anywhere in the electrical circuit between the strain gage bridge SGB and transistor switch Q2 and inhibits increase of the forward tilting moment on the truck if such a faulty electronic component prevents proper response of the protective system to the simulated overload. The negative terminal of the truck battery BATT may be grounded and its positive terminal may be connected to one side of the valve operating coils 47 and 50 through a fuse FU3 and a starting key electrical switch 72 which is operated when truck starting key 70 is turned on. It will be appreciated that starting key 70 may control an ignition switch if the truck is propelled by an internal combustion engine, or may control an electrical power switch which connects the battery BATT in a series circuit with a semiconductor power switch and the armature and field windings of a series traction motor if the truck is of the electrically operated type.

A unidirectional +8.5 volt power source PS for the electronic components of the protective system is enabled when starting key switch 72 is closed. Power source PS may include a NPN power transistor Q6 having its base connected through a zener diode ZD5 to ground, its emitter coupled to one electrode of a capacitor C5 having its other electrode grounded, and its collector connected to the positive terminal of battery BATT through the series arrangement of a fuse FU2, a diode D6, fuse FU2, and key switch 72. A resistance R24 is connected between base and collector of Q6.

Terminal 61 of the strain gage bridge SGB is connected through the series arrangement of a resistance R74 and a diode D5 to the collector of a NPN transistor Q9 having its emitter grounded. The collector of Q9 is connected through a resistance R75 to the +8.5 volt source, and the base of Q9 is connected through a resistance R76 to the output of a NOR logic gate N1 having one input grounded. The other input to gate N1 is coupled to the junction between a resistance R77 and a capacitor C9 connected in series between the +8.5 source and ground. The output of gate N1 is connected through a diode D16 to conductor 40 and thus to the RC time delay capacitor charging circuit R25, R26, C7.

In brief, the FIG. 2 embodiment places resistance R74 across leg G4 of strain gage bridge SGB to simulate a fault and also connects +8.5 volts to the crowbar circuit each time truck starting key 70 is turned on. The resulting closure of key switch 72 connects the positive terminal of battery BATT to the collector of power transistor Q6 to enable the power source PS and also applies power to the truck electrical system. The voltage across capacitor C9 is zero when the +8.5 volt source is initially applied, thereby providing a logic 0 input to gate N1 which provides a logic 1 output. The logic 1 output from gate N1 is coupled through diode D16 over conductor 40 to initiate charging of capacitor C7 through R25 and R26. The logic 1 output from gate N1 is also coupled through resistance R76 to the base of NPN transistor Q9 to turn it on, thereby connecting terminal 61 of strain gage bridge to ground through the series arrangement of resistance R74, diode D5, and the collector-emitter path of Q9. The connection of R74 across leg G4 unbalances bridge SGB and causes it to generate the tilting-moment signal of predetermined magnitude indicative of a truck overload. If the protection system is functioning properly, such unbalancing of bridge SGB will cause comparator COMP to generate the overload signal which will turn transistor switch Q2 off to thereby turn on Q5 and disable the capacitor charging circuit R25, R26, C7. However, if a faulty electronic component prevents proper response of the protective system, transistor Q2 will not turn off, and when a predetermined voltage is built up across capacitor C7, Q3 and Q4 will fire to rupture fuse F1 and thus disable the carriage elevating and mast tilting motors 21 and 22.

If the protective system is functioning properly, the voltage across capacitor C9 builds up sufficiently after approximately three seconds to change the input to gate N1 to logic 1 and its output to logic 0, thereby turning off transistor Q9 to remove the bridge unbalance and also remove the logic 1 signal on conductor 40 to the capacitor charging circuit R25, R26, 67. Thereafter the protective system will function normally.

Diode D5 prevents leakage current in transistor Q9 from affecting the calibration of bridge SGB, and resistor R75 provides an alternate path for Q9 leakage current.

While only a few embodiments of our invention have been illustrated and described, many modifications and variations thereof will be readily apparent to those skilled in the art, and consequently it should be understood that we do not intend to be limited to the particular embodiments shown and described.

The embodiments of the invention in which an exclusive property or privilege is claimed are defined as follows:

1. In a lift truck having a tilting mast, a mast tilting motor, a load supporting carriage, a carriage elevating motor for raising and lowering said carriage on said mast, overload protective means including sensor means for deriving an electrical tilting-moment signal proportional to the tilting moment acting on the truck as a result of a load on the raised carriage, comparator means for deriving an overload signal when said tilting-moment signal reaches a predetermined magnitude indicative of an overload on said truck, an electrical switch coupled to the output of said comparator means and normally being held unoperated by said output and being operable in response to said overload signal, means for disabling said carriage elevating and mast tilting motors in response to operation of said electrical switch, and crowbar circuit means coupled to the output of said comparator means and to said electrical switch for operating said disabling means in response to: (a) said overload signal, plus (b) said electrical switch remaining unoperated after a preset time delay subsequent to the occurrence of said overload signal, whereby the carriage of an overload truck cannot be shifted in a direction to increase the tilting moment in the event said overload protective means does not respond properly to an overload.

2. In the combination of claim 1 wherein said crowbar circuit means includes an RC capacitor charging circuit which receives said overload signal as an input, means controlled by said electrical switch for enabling and disabling said capacitor charging circuit when said electrical switch is unoperated and operated respectively and means responsive to a predetermined voltage across said capacitor for operating said motor disabling means.

3. In the combination of claim 2 wherein said means responsive to a predetermined voltage across said capacitor for operating said motor disabling means includes a rupturable fuse connected in an electrical circuit with said electrical switch so that said electrical switch cannot be operated when said fuse is ruptured, and means responsive to said predetermined voltage across said capacitor for rupturing said fuse to thereby actuate said motor-disabling means in the event said electrical switch does not operate in response to said overload signal.

4. In the combination of claim 1 and including means for selectively simulating an overload on said truck so that said sensor means derives a tilting-moment signal having a magnitude at least equal to said predetermined magnitude to thereby permit selective testing of said overload protective means.

5. In the combination of claim 1 wherein said truck has electrical switch means for controlling application of electrical power to the truck electrical system, and including means operable in response to actuation of said electrical switch means for causing said sensor means to derive a tilting-moment signal equal to said predetermined magnitude and for simultaneously applying to said crowbar circuit means an electrical signal analogous to said overload signal.

6. In the combination of claim 1 wherein said electrical switch is of the semiconductor type and is normally held conducting by the output from said comparator means and is operated to nonconducting condition in response to said overload signal, said motor-disabling means is operated when said semiconductor switch is turned off, and said crowbar circuit means opens the electrical circuit to said semiconductor switch to turn it off in response to: (a) said overload signal, plus (b) said semiconductor remaining conductive after a time delay subsequent to the occurrence of said overload signal.

7. In the combination of claim 6 wherein said motor-disabling means comprises first and second electrically operated hydraulic valves having operating coils in series with said semiconductor switch which are energized and hold said valves in open position when said switch is conducting and which are actuated to closed position when said switch is turned off to respectively disable said mast tilting motor from tilting said mast further in the forward direction and to disable said carriage elevating motor from raising said carriage further.

8. In the combination of claim 6 wherein said crowbar circuit means includes an RC capacitor charging circuit which receives said overload signal as an input and means controlled by said semiconductor switch for disabling said capacitor charging circuit when said semiconductor switch is turned off to thereby prevent said capacitor from accumulating a charge.

9. In the combination of claim 8 wherein said crowbar circuit means includes a rupturable fuse in series with said semiconductor switch, and means responsive to a predetermined voltage across said capacitor for rupturing said fuse to thereby turn off said semiconductor switch and actuate said motor-disabling means.

10. In the combination of claim 9 wherein said semiconductor switch is a transistor, and said motor-disabling means comprise first and second electrically operated hydraulic valves having operating coils in series with the emitter-collector path of said transistor and said fuse and which are energized and hold said valves in open position when said transistor is turned on and which are actuated to closed position when said transistor is turned off to respectively disable said mast tilting motor from tilting said mast further in the forward direction and to disable said carriage elevating motor from raising said carriage further.

11. In the combination of claim 10 wherein said means for disabling said capacitor charging circuit includes a transistor having its collector-emitter path in shunt to said capacitor and whose base is coupled to the collector of said semiconductor switch transistor.

12. In a lift truck having a tilting mast, a mast tilting motor, a load supporting carriage, a carriage elevating motor for raising and lowering said carriage on said mast, overload protective means including sensor means for deriving an electrical tilting-moment signal proportional to the tilting moment acting on the truck as a result of a load on the raised carriage, comparator means for deriving an overload signal when said electrical tilting-moment signal reaches a predetermined magnitude indicative of an overload on said truck, a semiconductor switch coupled to the output of said comparator means and normally being held conducting by said output and being turned off in response to said overload signal, means controlled by said semiconductor switch for disabling said carriage elevating and mast tilting motors in response to turning off of said switch, and crowbar circuit means including an RC capacitor charging circuit receiving said overload signal as an input for opening, after a preset time delay, the electrical circuit to said switch to thereby turn it off in response to: (a) said overload signal, plus (b) said switch remaining conducting after said time delay subsequent to the occurrence of said overload signal, said last-named means including means for enabling and disabling said capacitor charging means when said semiconductor switch is turned on and turned off respectively, whereby said carriage cannot be shifted in a direction to increase said tilting moment if said overload protective means does not respond properly to said overload.

13. In the combination of claim 12 wherein said sensor means includes a load carrying member on said truck subjected to said tilting moment and a plurality of strain gages mounted on said load carrying member and arranged in an electrical bridge adapted to sense the mechanical strain on said load carrying member and to generate said electrical tilting-moment signal.

14. In the combination of claim 13 and including overload simulating means for selectively unbalancing said bridge so that it generates said tilting-moment signal of said predetermined magnitude.

15. In the combination of claim 14 wherein said overload simulating means for selectively unbalancing said bridge also applies to said electrical circuit opening means an electrical signal analogous to said overload signal.

16. In the combination of claim 13 wherein said truck has electrical switch means for controlling application of electrical power to the truck electrical system, and including overload simulating means responsive to the actuation of said electrical switch means for unbalancing said electrical bridge so that it derives said tilting-moment signal of said predetermined magnitude and for simultaneously applying to said electrical circuit opening means an electrical signal having a magnitude substantially equal to said overload signal.

17. In a lift truck having a tilting mast, a mast tilting motor, a load supporting carriage, a carriage elevating motor for raising and lowering said carriage on said mast, overload protective means including sensor means for deriving an electrical tilting-moment signal proportional to the tilting moment acting on the truck as a result of a load on the raised carriage, said sensor means including a load carrying member on said truck subjected to said tilting moment and a plurality of strain gages on said load carrying member arranged in an electrical bridge for sensing the mechanical strain in said load carrying member and for deriving said tilting-moment signal, comparator means for deriving an overload signal when said tilting-moment signal reaches a predetermined magnitude indicative of an overload on said truck, a semiconductor switch coupled to the output of said comparator means and normally being turned on by such output and being turned off in response to said overload signal, means for disabling said carriage elevating and mast tilting motors in response to turning off of said semiconductor switch whereby said carriage cannot be shifted in a direction to increase said tilting moment if said overload protective means does not respond properly to said overload, and means including a rupturable fuse connected in an electrical circuit with said semiconductor switch for turning off said switch, to thereby operate said motor disabling means, in response to: (a) said overload signal, plus (b) said semiconductor switch remaining conducting after a preset time delay subsequent to the occurrence of said overload signal, said last-named means including an RC capacitor charging circuit which receives said overload signal as an input, means for enabling and disabling said capacitor charging circuit when said semiconductor switch is turned on and off respectively, and means responsive to a predetermined voltage across said capacitor for rupturing said fuse.

18. In the combination of claim 17 and including means for selectively unbalancing said bridge to thereby generate a tilting-moment signal of said predetermined magnitude and simulate an overload on said truck.

19. In the combination of claim 18 wherein said truck has electrical switch means which controls application of electrical power to the truck electrical system, and wherein said means for selectively unbalancing said bridge is operated in response to the actuation of said electrical switch means.

20. In the combination of claim 19 and including means responsive to the actuation of said electrical switch means for simultaneously applying an electrical signal to said RC capacitor charging circuit having a magnitude at least equal to said overload signal.

* * * * *